US005483902A

United States Patent [19]

Grosch

[11] Patent Number: 5,483,902

[45] Date of Patent: Jan. 16, 1996

[54] ADJUSTABLE WORK SURFACE FOR COMPUTER STATIONS

[76] Inventor: Peter T. Grosch, 1456 Rockwell Rd., Abington, Pa. 19001

[21] Appl. No.: 121,204

[22] Filed: Sep. 14, 1993

[51] Int. Cl.[6] ..... A47B 11/00

[52] U.S. Cl. ..... 108/143; 248/244

[58] Field of Search ..... 312/106, 350, 312/334.4; 108/143; 248/243, 244

[56] References Cited

U.S. PATENT DOCUMENTS

| | | | |
|---|---|---|---|
| 668,038 | 2/1901 | Duhamel | 248/243 |
| 1,855,245 | 4/1932 | Kuenzel | 312/243 |
| 3,087,771 | 4/1963 | Pari | 312/350 |
| 3,162,416 | 12/1964 | Amarillas | 248/244 |
| 4,681,381 | 7/1987 | Sevey | 312/350 |

OTHER PUBLICATIONS

United Stationers Catalog, 1994.
United Stationers Catalog, 1994.
Balt Catalog, p. 34.

*Primary Examiner*—Kenneth J. Dorner
*Assistant Examiner*—Gerald A. Anderson
*Attorney, Agent, or Firm*—Howson and Howson

[57] ABSTRACT

An ergonomic console for a computer workstation having a horizontally extendible shelf which is vertically adjustable in increments of height to provide a comfortable clearance for different size persons. The shelf is slidable in tracks at either end, and adjuster plates on the interior sides of the console include vertical slots with rearwardly extending notches at spaced intervals which receive bushings extending from either end portion of the tracks.

17 Claims, 2 Drawing Sheets

Fig. 1
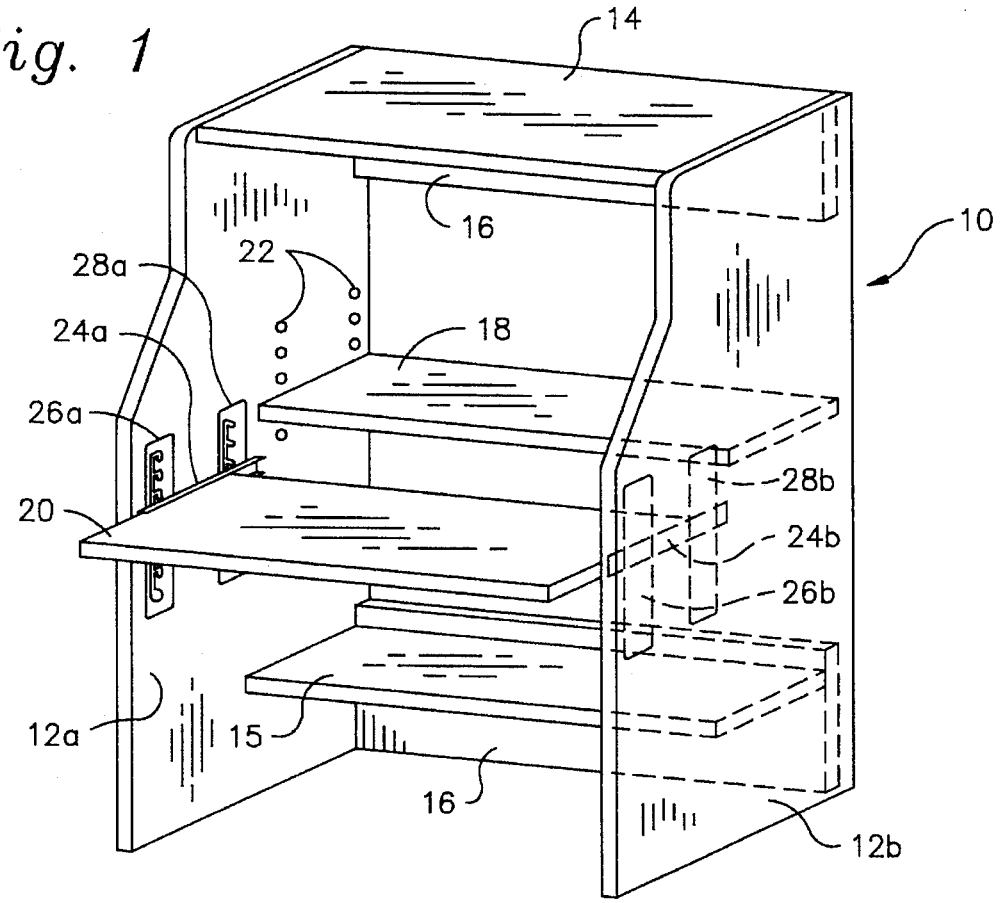
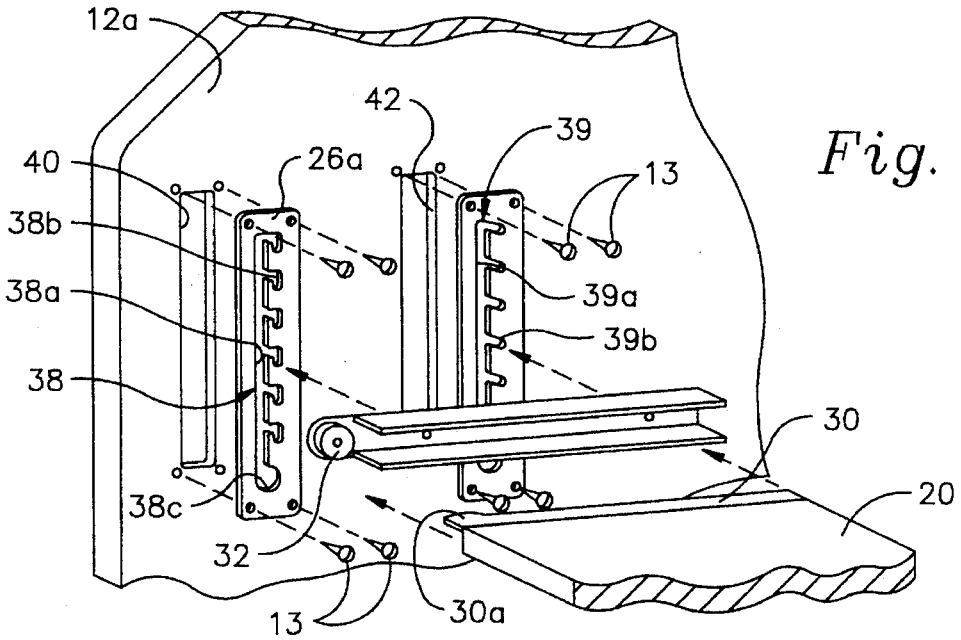
Fig. 2

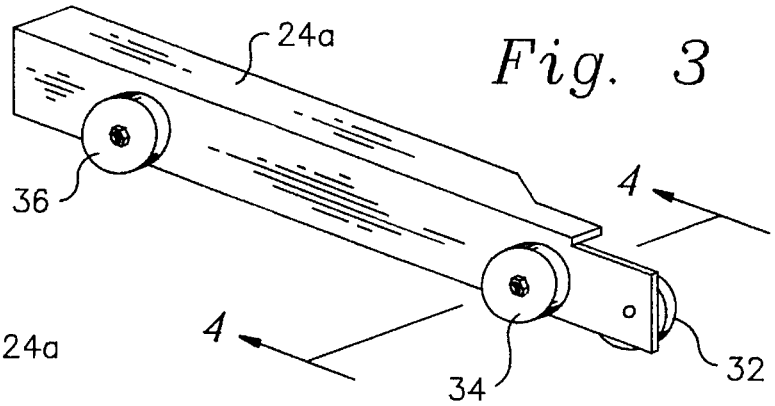
Fig. 3
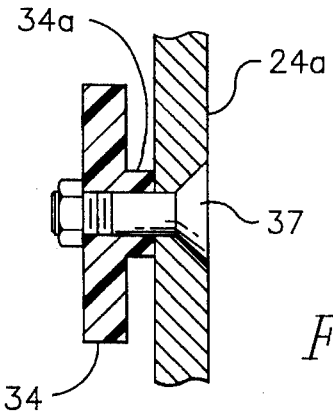
Fig. 4
Fig. 5a
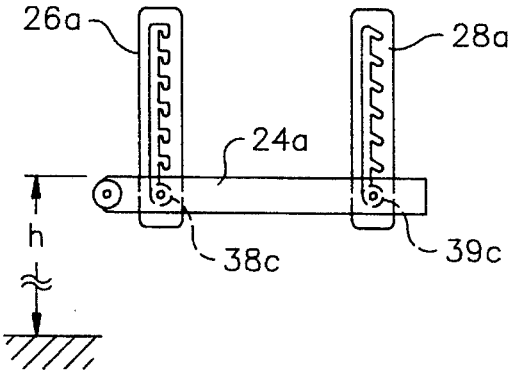
Fig. 5b
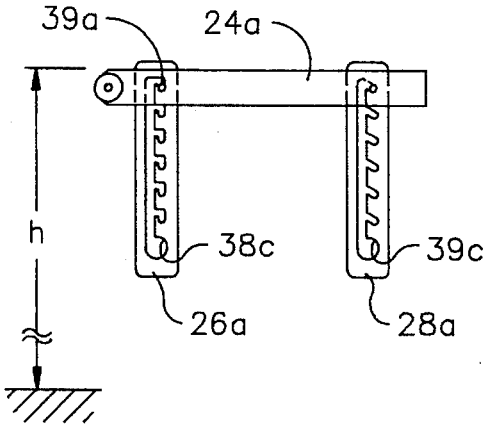
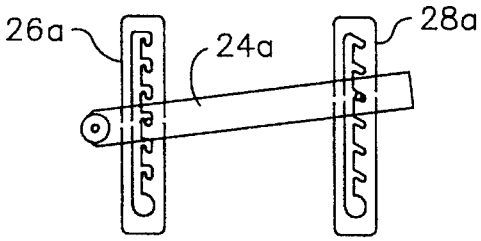
Fig. 5c
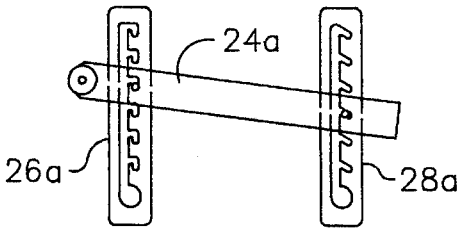
Fig. 5d

ADJUSTABLE WORK SURFACE FOR COMPUTER STATIONS

BACKGROUND OF THE INVENTION

The present invention relates generally to furniture, and more particularly to an adjustable work surface for supporting a computer keyboard, monitor, mouse, digitizer board, joy stick or like accessories in a computer workstation.

Computer workstations are designed to be attractive and to provide an ergonomic interface with the computer operator for maintaining optimum proficiency over prolonged intervals of time without fatigue or physical discomfort. The workstation typically includes a monitor positioned on a shelf within an open console for viewing above, at or below the operator's eye level, and a keyboard located in front of the monitor on a separate shelf. The heights of the shelves from the floor, may be made adjustable by interengaging the ends of the shelves with vertically aligned fittings spaced vertically from one another at intervals on the interior sides of the console.

The keyboard height is especially critical. During keying, the operator's wrists should remain in a neutral position—not bent up, down or sideways—to reduce discomfort from unnecessary wrist stress. Improper wrist position over a prolonged period may increase risk of repetitive strain injury, a common form of mononeuropathy referred to as carpal tunnel syndrome. Therefore, the anthropometric parameters of the operators are important design criteria for workstations in general, and for keyboard shelf height in particular. ANSI/HFS 100-1988 Standards for Independent Keyboard Surfaces, Independent Display Surfaces and Clearance Under Work Surfaces, for example, require a minimum surface height from the floor of 23 inches for the 5th percentile female (approximately 5'0" tall) and 28 inches for the 95th percentile male (approximately 6'2" tall). However, the keyboard shelf should be adjustable within a range of greater heights to accommodate shorter and taller operators, as well as or the unique personal preferences of operators between the 5th and 95th percentiles.

Another feature often desired in computer consoles is a horizontally slidable keyboard shelf which can be completely retracted into the console when it is not in use. However, such keyboard shelves cannot be easily adjusted vertically. This is because the tracks in which the ends of the shelf move are permanently attached to the interior sides of the console. To reposition the keyboard to another height from the floor, the shelf must be removed from the tracks in order to allow access to the means fastening the guides to the console. This is time-consuming and often impractical, especially when several operators, short and tall, share the same workstation. Instead, the operators might forego adjusting the height and unwittingly expose themselves to the insidious consequences of wrist strain.

Accordingly, it is an object of the present invention to provide, in a computer workstation, a work surface for a keyboard and like control accessories which can be ergonomically adjusted in height to alleviate discomfort from unnecessary wrist stress to the operator.

Another object is to provide, in a console, a horizontally extendible work surface which can be quickly and easily adjusted, within a range of heights, to suit the physical comfort and unique preferences of users.

Still another object is to provide a work surface which is horizontally slidable between supporting sides of a workstation, and the height of which can be easily adjusted.

A still further object is to provide a horizontally slidable work surface which can be changed from a horizontal position to a forwardly or rearwardly slanted position.

Still another object is to provide a work surface for a workstation which is simple to adjust in height and slant, which is completely retractable, and which can securely support a computer keyboard and other items employed by an operator.

Briefly, these and other objects and aspects of the invention are accomplished by a workstation having the following construction. A supporting surface is provided, having opposite edge, each edge having a track-engaging slide. A pair of tracks is provided, the tracks being located alongside the opposite edges of the supporting surface and slidably receiving the track-engaging slides to permit sliding of the supporting surface in a path defined by the tracks. Each of the tracks has front and rear projections for engaging a supporting slot. First and second plate means are provided. The first plate means is located alongside one of the opposite edges of the supporting surface, and the second plate means is located alongside the other of the opposite edges of the supporting surface. Each of the first and second plate means is supported at a predetermined height. The first plate means has a front supporting slot receiving the front projection of one of the tracks and a rear supporting slot receiving the rear projection of the same track. The second plate means has a front supporting slot receiving the front projection of the other track and a rear supporting slot receiving the rear projection of the same track. One of the slots in each plate means comprises a vertically elongated section having a plurality of notches extending therefrom, at vertically spaced locations, in a direction transverse to the direction of elongation of the slot, for receiving one of the projections. The other of the slots in each plate means also comprises a vertically elongated section having a plurality of notches extending therefrom, at vertically spaced locations. Each of the latter notches extends transverse to the direction of elongation of said other of the slots and has a downwardly extending pocket formed therein and spaced from the vertically elongated section, for receiving another one of the projections. With this structure, for vertical adjustment of the position of the supporting surface, the track-providing means must be moved upward, and then horizontally, to position the projections in the vertically elongated sections of the slots.

Further objects, advantages and details of the invention will become apparent from the following detailed description when read in conjunction with the drawings.

BRIEF DESCRIPTION OF THE DRAWINGS

FIG. 1 is an isometric view of a computer workstation with an adjustable keyboard shelf according to the invention;

FIG. 2 is an exploded view of front and rear adjuster plates, a track, and one end of the shelf, spatially offset from the left side of the workstation of FIG. 1;

FIG. 3 is an isometric view of the track of FIG. 2 taken from the side normally facing the adjuster plates;

FIG. 4 is a view in cross section of the track taken on plane 4—4 of FIG. 3; and FIGS. *5a–5d* are schematic views in elevation of the track installed in the front and rear adjuster plates showing the track supported at various heights and slants.

DETAILED DESCRIPTION

Referring now to the drawings, wherein like reference characters designate like or corresponding parts throughout the several views, there is shown in FIG. 1 a desk-like open console, generally indicated by the reference number 10, designed as a workstation for a computer terminal including a CPU, video monitor and a keyboard. Console 10 may be constructed of solid wood, laminate or particle board, molded solid plastics or other materials suitable for rigid construction. It includes left and right side panels 12*a* and 12*b* in fixed parallel relation by a horizontal top shelf 14, bottom shelf 15 and back panels 16. Shelves 14 and 15 provide fixed support surfaces for a CPU and other computer components and accessories (not shown) such as a printer or program libraries. A vertically adjustable video monitor shelf 18 is supported between the interior sides of panels 12*a* and 12*b* by a pair of dowel pins (not visible in the drawing) beneath the ends. The pins are removably inserted into selected ones of holes 22 which are arranged in the panels along two parallel vertical rows in several increments of elevation.

The keyboard (not shown) is supported on a shelf 20 in which the ends slide horizontally within reciprocal tracks 24*a* and 24*b* between a fully retracted position in console 10 and extended operating position. Without having to be removed from console 10, shelf 20 is also vertically adjustable by the positioning of the tracks in reciprocal front adjuster plates 26*a* and 26*b* and reciprocal rear adjuster plates 28*a* and 28*b* fixed to the interior sides of respective panels 12*a* and 12*b*.

Track 24*b*, and adjuster plates 26*b* and 28*b* are mirror images respectively of track 24*a* and adjuster plates 26*a* and 28*a*, which are described hereinbelow with reference to FIG. 2. Track 24*a* defines in cross section a U-shaped channel in which the adjacent end of shelf 20 slides. A rail 30 extending from the end of shelf 20 rides on an idler wheel 32 for reducing friction between shelf 20 and track 24. The bottom surface at the front end 30*a* of rail 30 is indented to bias shelf 20 toward the retracted position when idler 32 and the indentation register.

As best seen in FIGS. 3 and 4, track 24*a* further includes front and rear bushings 34 and 36, secured thereto by nut and bolt fasteners 37, and positioned to extend through apertures 38 and 39 of adjuster plates 26*a* and 28*a* and into recesses 40 and 42 formed in panel 12*a*, and located behind the plates. Aperture 38 comprises a narrow vertical slot 38*a* with rearwardly and downwardly curved notches 38*b* at vertically spaced increments, and an enlarged opening 38*c* at the lower end sufficient for passing bushing 34 when initially installing track 24*a*. A neck portion 34*a* of bushing 34 next to track 24*a* is reduced in size an amount sufficient for it to slide along slot 38*a* and seat in any one of notches 38*b* when bushing 34 is fully inserted through adjuster plate 26*a*. The curvature of notches 38*b* forms pockets which restrict bushing 34 from horizontal motion and thereby prevent track 24*a* from being repositioned without first lifting bushing 34 from the pocket. Aperture 39 similarly defines a narrow vertical slot 39*a* with notches 39*b* slanted rearwardly and downwardly at vertically spaced increments. An enlarged opening 39*c* at the lower end of slot 39*a* permits bushing 36 to be initially installed in plate 28*a*. Unlike the curved notches in plate 26*a*, the notches 39*b* are slightly slanted in order to permit bushing 36 to slide out freely without being first lifted.

Installation and use of the invention are extremely simple and require no special tool or mechanical aptitude. With adjuster plates 26*a*, 26*b* and 28*a*, 28*b* previously mounted in place over recesses 40 and 42 in panels 12*a* and 12*b*, bushings 34 and 36 of each track 24*a* and 24*b* are inserted through enlarged openings 38*c* and slid upward along vertical slots 38*a* and 39*b* and rearwardly into selected notches 38*a* and 39*b* of the same elevation. The ends of shelf 20 are then slid into tracks 24*a* and 24*b*. When fully inserted into console 10, shelf 20 is biased toward the retracted position by interengagement of idler 32 and the indentation at end 30*a*. The height of the work surface from the floor may be adjusted easily. The operator may withdraw shelf 20 straight out from the tracks, move the tracks to notches 38*a* and 39*a* at another level, and replace the shelf. It is also possible to adjust the height without removing the shelf by simply lifting the front end of the shelf 20 together with tracks 24*a* and 24*b*, and drawing them from the console until the bushings 34 and 36 can slide in the vertical slots 38*a* and 39*b* to different notches 38*b* and 39*b*.

FIGS. 5*a*–5*d* illustrate typical examples of seven levels of track settings for various shelf positions which meet or exceed the ANSI/HFS 100-1988 Standards range for adjustable work surface heights of 23 inches to 28 inches although any heights may be achieved by making the plates larger, with more slots, or placing them in different positions on the side panels. In FIG. 5*a*, the track 24*a* is in its lowest position at openings 38*c* and 39*c* to provide a horizontal work surface height h of 23 inches from the floor. In FIG. 5*b*, track 24*a* is in its highest position in the top notches 38*b* and 39*b* to provide a horizontal work surface at a height h of 28 inches. In FIGS. 5*c* and 5*d* the bushings of track 24*a* are in different notches of the front and back adjuster plates 26*a* and 28*a* to provide a forward or rearward incline to the work surface. The straight slant of notches 39*b* allows front bushing 34 to remain fully seated in curved notches 38*b* at different inclined positions.

Modification of the console and adjustable surface are possible within the scope of the invention.

For example, while, in the embodiment specifically described and shown, separate front and rear slotted plates are provided on each side of the console to receive the respective front and rear bushings of the tracks, it is possible to provide a single plate, having both front and rear slots, on each side of the console. This modification is particularly useful underneath table tops, where no vertical panels are available for the mounting of separate front and rear plates.

The invention may be used to provide an adjustable monitor support shelf or an adjustable shelf for supporting a printer or other article.

Some of the many advantages and novel features of the invention should now be readily apparent. For example, a work surface for a computer workstation is provided which is adjustable within a range of heights which ergonomically alleviates discomfort from unnecessary wrist stress to the operator and which can be designed to meet or exceed ANSI/HFS 100-1988 Standards. The work surface is horizontally extendible, can be adjusted in height to suit the physical comforts and any unique preferences of users, can be inclined inwardly or outwardly from a horizontal position, and is relatively simple to adjust, in both height and inclination, without any special skills or tools.

It will be understood that various other changes in the details, steps and arrangement of parts, which have been herein described and illustrated in order to explain the nature of the invention, may be made by those skilled in the art within the principal and scope of the invention as expressed in the appended claims.

I claim:

1. A workstation comprising:

means providing a supporting surface having opposite edges, each having track-engaging slide means;

means providing a pair of tracks located alongside said opposite edges of the supporting surface and slidably receiving said track-engaging slide means to permit sliding of said supporting surface in a path defined by said tracks, each of said tracks having supporting slot-engaging means comprising a front projection and a rear projection;

first and second plate means, the first plate means being located alongside one of said opposite edges of the supporting surface and the second plate means being located alongside the other of said opposite edges of the supporting surface; and means supporting each of said first and second plate means at a predetermined height;

the first plate means having a front supporting slot receiving the front projection of one of said tracks and a rear supporting slot receiving the rear projection of said one of said tracks;

the second plate means having a front supporting slot receiving the front projection of a second of said pair of tracks and a rear supporting slot receiving the rear projection of said second track;

one of the slots in each plate means comprising a vertically elongated section having a plurality of straight notches extending obliquely downwardly therefrom, at vertically spaced locations, in a direction transverse to the direction of elongation of the vertically elongated section of the slot, for receiving one of said projections; and the other of the slots in each plate means comprising a vertically elongated section having a plurality of curved notches extending therefrom, at vertically spaced locations, each of the curved notches extending transverse to the direction of elongation of the vertically elongated section of said other of the slots and having a downwardly extending pocket formed therein and spaced from the vertically elongated section, for receiving another one of said projections;

whereby, for vertical adjustment of the position of the supporting surface, the track-providing means must be moved upward, and then horizontally, to position said projections in the vertically elongated sections of the slots.

2. A workstation according to claim 1 in which each of said projections on each track is a bushing having a neck portion located in a slot of one of said plate means and an enlarged portion located on the side of the plate means remote from the track.

3. A workstation according to claim 1 in which each of said projections on each track is a bushing having a neck portion located in a slot of one of said plate means and an enlarged port, ion located on the side of the plate means remote from the track, and in which each of said slots has an opening at one end thereof sufficiently large to allow passage of the enlarged portion, and in which the remaining portions of the slot are sufficiently narrow to prevent passage of said enlarged portion therethrough.

4. A workstation according to claim 1 in which each of said first and second plate means comprises a front plate having a front supporting slot and a rear plate having a rear supporting slot.

5. A workstation according to claim 4 in which said means supporting each of said first and second plate means at a predetermined height comprises a first upright panel on which are mounted the front and rear plates of the first plate means and a second upright panel on which are mounted the front and rear plates of the second plate means.

6. A workstation according to claim 4 in which said means supporting each of said first and second plate means at a predetermined height comprises a first upright panel having a face on which are mounted the front and rear plates of the first plate means and a second upright panel having a face on which are mounted the front and rear plates of the second plate means, in which each of said projections on each track is a bushing having a neck portion located in a slot of one of said plate means and an enlarged portion located on the side of the plate means remote from the track, and in which each of said upright panels has a hollow recess covered by each plate mounted thereon, the hollow recesses providing clearance for said enlarged portions of the projections.

7. Apparatus for adjusting within predetermined limits the height of a slidable shelf having opposite ends, the shelf being supported at said opposite ends between a pair of upright panels of an article of furniture, said article of furniture having a front and rear, and said upright panels having opposed interior sides, comprising, in combination:

first and second adjuster plate means fixed in a facing relation to each other, one of said plate means being attached to an interior side of one of said panels, and the other of said plate means being attached to an interior side of the other of said panels, each of said plate means containing front and rear vertical slots extending between the predetermined limits and notches communicating lengthwise intervals with each of said front and rear vertical slots and extending toward the rear of the article of furniture; and a pair of tracks one of the tracks being slidably received on one of the shelf ends and the other of the tracks being slidably received on the other of the shelf ends, each of said tracks having front and rear end portions and including front and rear bushings extending respectively from its said front and rear end portions and slidable in adjacent slots and notches of adjacent of said adjuster plate means;

wherein said notches communicating with said front slots curve downward forming pockets which prevent forward motion of said tracks while said front bushings are seated therein; and wherein said notches communicating with said rear slots are straight and slant downward to form pockets which permit forward motion of said tracks while said rear bushings are situated in said notches communicating with said rear slots.

8. Apparatus according to claim 7 wherein said front and rear bushings each have a distal end and include a collar formed on the distal end, and said adjuster plates include an enlarged opening at the bottom of each of said slots just sufficient for passage of said collar.

9. Apparatus according to claim 8 further comprising recess means in communication with the side of each of said adjuster plates adjacent the panels for receiving said collar when said bushings are slidably engaged in said slots and said notches.

10. Apparatus according to claim 7 wherein said slots and said notches are positioned to provide an incremental adjustment in height from the base of the upright panels to any desired height within a predetermined range.

11. An article of furniture comprising:

a pair of uprights spaced from each other;

first plate means fixed to one of said uprights, and second plate means fixed to the other of said uprights, said first and second plate means being in opposing relation to each other; and a shelf positioned between said uprights and having an article-supporting surface, a first side edge adjacent to one of said uprights and a second side edge adjacent to the other of said uprights, the shelf having a first pair of projections extending outward from its first side edge in a direction away from said second side edge, and a second pair of projections extending outward from its second side edge in a direction away from said first side edge, the projections of each of said first and second pairs of projections from each other by the same distance;

wherein the first plate means comprises first and second vertically extending slots in parallel relationship to each other with the first slot spaced forward of the second slot by a distance such that the first and second slots can respectively receive the projections of the first pair of projections while the article-supporting surface is in a predetermined relationship to the horizontal and the projections of the first pair of projections can be moved vertically, in said first and second slots simultaneously, to allow for vertical movement of said shelf;

wherein the second plate means comprises third and fourth vertically extending slots in parallel relationship to each other, with the third slot spaced forward of the fourth slot by a distance such that the third and fourth slots can respectively receive the projections of the second pair of projections while the article-supporting surface is in said predetermined relationship to the horizontal and the projections of the second pair of projections can be moved vertically, in said third and fourth slots simultaneously with each other, and simultaneously with the movement of the projections of the first pair of projections in said first and second slots, to allow for vertical movement of said shelf;

wherein each of said first, second, third and fourth vertically extending slots has a set of vertically spaced notches extending therefrom, each notch being capable of receiving one of said projections from the vertically extending slot from which the notch extends and supporting said one of said projections against downward movement;

wherein the first and third vertically extending slots are disposed opposite to each other and constitute a front pair of slots and the second and fourth vertically extending slots are disposed opposite to each other and constitute a rear pair of slots;

wherein each of the notches of the slots of one of the front and rear pairs of slots curves downward forming a pocket adapted to receive one of said projections from the vertically extending slot from which the notch extends and restrain the last-mentioned projection against forward and rearward movement; and wherein each of the notches of the slots of the other of the front and rear pairs of slots is straight and slants downward to receive a projection from the vertically extending slot from which the notch extends and permits forward and rearward motion of the last-mentioned projection;

whereby the shelf can be securely supported on said uprights with the article supporting surface of the shelf disposed at least at two different angles relative to the horizontal.

12. A workstation for a computer terminal comprising, in combination:

a console having a pair of upright side panels having opposed interior sides;

first and second adjuster plate means fixed in facing relation to each other, plate means being attached to an interior side of one of said panels and the other of said plate means being attached to an interior side of the other of said panels, each of said plate means having front and rear vertical slots extending between height limits and rearwardly extending notches communicating with each of said front and rear vertical slots at intervals within said height limits;

a pair of tracks, each having opposite end portions and including front and rear bushings extending from opposite end portions of each said tracks and slidable in said slots and said notches; and a shelf having opposite ends and slidably supported at said opposite ends by said tracks;

wherein said notches communicating with said front slots curve downward, forming pockets which prevent forward motion of said tracks while said front bushings are seated in said notches communicating with said front slot; and wherein said notches communicating with said rear slots are straight and slant downward, forming pockets which permit forward motion of said tracks which said rear bushings are situated in said notches communicating with said rear slots.

13. A workstation according to claim 12 wherein said front and rear bushings each have a distal end and include a collar formed on the distal end, and said adjuster plates each include an enlarged opening at the bottom of each of said slots just sufficient for passage of said collar.

14. A workstation according to claim 13 further comprising recess means communication with the side of each of said adjuster plates adjacent the panels for receiving said collar when said bushings are slidably engaged in said slots and said notches.

15. A workstation according to claim 13 wherein said slots and said notches are positioned to provide an incremental adjustment in height from the base of the upright panels to any desired height within a predetermined range.

16. A method for adjusting the height of the shelf in the workstation of claim 13 comprising the steps of:

concomitantly lifting and withdrawing the forward edge of the shelf and tracks from the console until the front and rear bushings register with the front and rear vertical slots;

repositioning the shelf along the slots to selected notches corresponding to the desired height; and concomitantly moving the shelf and tracks rearwardly into the selected notches until fully seated.

17. A method for adjusting the height of the shelf in the workstation of claim 13 comprising the steps of; removing the shelf from the tracks, repositioning the tracks in selected notches corresponding to the desired height and replacing the shelf in the track.

* * * * *